US006470537B1

(12) United States Patent
Schallenkamp

(10) Patent No.: US 6,470,537 B1
(45) Date of Patent: Oct. 29, 2002

(54) FOOTWEAR CLOSURE FASTENER REPLACEMENT SYSTEM

(76) Inventor: John H. Schallenkamp, 25705 - 435th Ave., Bridgewater, SD (US) 57319

( * ) Notice: Subject to any disclaimer, the term of this patent is extended or adjusted under 35 U.S.C. 154(b) by 0 days.

(21) Appl. No.: 09/815,707

(22) Filed: Mar. 23, 2001

(51) Int. Cl.[7] ..... A43C 11/14
(52) U.S. Cl. ..... 24/70 SK; 24/69 SK
(58) Field of Search ..... 36/50.1, 50.5; 24/68 R, 70 SK, 71 SK, 68 SK, 69 R, 69 SK

(56) References Cited

U.S. PATENT DOCUMENTS 1,474,168 A * 11/1923 Russell
2,040,001 A 5/1936 Jones
2,243,506 A 5/1941 Mitchell
2,525,269 A * 10/1950 Olson
3,600,761 A * 8/1971 Mathey
3,730,247 A 5/1973 White
3,996,085 A 12/1976 Barnes et al.
4,011,634 A * 3/1977 Olivieri
4,096,605 A * 6/1978 Annovi
4,386,472 A 6/1983 Shimano
4,551,876 A 11/1985 Leslie
4,638,547 A 1/1987 Roda
4,692,362 A 9/1987 Johnson
4,907,352 A * 3/1990 Ginsberg
5,086,552 A 2/1992 Moore
5,226,246 A * 7/1993 Soo
5,454,172 A 10/1995 Crigger
5,472,750 A 12/1995 Miller
5,675,954 A 10/1997 Garcia
5,695,577 A 12/1997 Ferrara
5,938,025 A * 8/1999 Chernack

* cited by examiner

*Primary Examiner*—James R. Brittain

(57) ABSTRACT

A footwear closure fastener replacement system for permitting replacement of broken footwear closure fasteners so that the footwear does not have to be replaced. The footwear closure fastener replacement system includes a ladder assembly for mounting on an article of footwear. Each ladder assembly includes a ladder base panel having a lower surface for adhering to the outer surface of the footwear. A ladder member is pivotally mounted on the ladder base panel. A plurality of clasp receiving apertures are formed on the ladder member, and the ladder member has a mounting hole adjacent one end of the ladder member. A ladder securing strip secures the ladder member to the ladder base panel, and the ladder securing strip extends through the mounting hole of the ladder member. Another aspect of the invention comprises a clasp assembly for mounting on the footwear. The clasp assembly includes a clasp base panel having a lower surface for adhering to the outer surface of the footwear. The clasp member is pivotally mounted on the clasp base panel. A clasp securing strip pivotally mounts the clasp member to the base panel.

18 Claims, 3 Drawing Sheets

FOOTWEAR CLOSURE FASTENER REPLACEMENT SYSTEM

BACKGROUND OF THE INVENTION

1. Field of the Invention

The present invention relates to footwear repair systems and more particularly pertains to a new footwear closure fastener replacement system for permitting replacement of broken footwear closure fasteners so that the footwear does not have to be replaced.

2. Description of the Prior Art

Article of footwear often have slits formed in a vamp portion of the upper of the footwear for permitting enlargement of the leg opening of the footwear when the footwear is being put on or removed from the foot of the wearer. The slit is then typically held in a substantially closed orientation during wearing of the footwear. A number of pairs of fasteners are usually mounted on opposite sides of the slit to hold the sides of the slit together.

The fasteners, especially those on work footwear such as boots, are vulnerable to breaking. Once one of the fasteners breaks, the closing of the slit is compromised, and consequently the fit of the footwear on the foot is also often compromised. The fasteners are difficult, if not impossible, to be repaired, especially if the footwear needs to be waterproof and the upper cannot be punctured without losing the waterproof quality. This has often led to discarding of the footwear before the footwear is otherwise worn out.

The footwear closure fastener replacement system according to the present invention solves this problem by providing an apparatus primarily developed for the purpose of permitting replacement of broken footwear closure fasteners so that the footwear does not have to be replaced.

SUMMARY OF THE INVENTION

In view of the foregoing disadvantages inherent in the known types of footwear repair systems now present in the prior art, the present invention provides a new footwear closure fastener replacement system construction wherein the same can be utilized for permitting replacement of broken footwear closure fasteners so that the footwear does not have to be replaced.

To attain this, the present invention generally comprises a ladder assembly for mounting on an article of footwear. Each ladder assembly includes a ladder base panel having a lower surface for adhering to the outer surface of the footwear. A ladder member is pivotally mounted on the ladder base panel. A plurality of clasp receiving apertures are formed on the ladder member, and the ladder member has a mounting hole adjacent one end of the ladder member. A ladder securing strip secures the ladder member to the ladder base panel, and the ladder securing strip extends through the mounting hole of the ladder member. Preferably, the ladder member is mounted adjacent one of the ends of the ladder base member such that the ladder member is pivotable into an extended position in which the ladder member extends beyond the end of the ladder base member. Another aspect of the invention comprises a clasp assembly for mounting on the footwear. The clasp assembly includes a clasp base panel having a lower surface for adhering to the outer surface of the footwear. The clasp member is pivotally mounted on the clasp base panel. A clasp securing strip pivotally mounts the clasp member to the base panel. Preferably, the clasp member is mounted adjacent one of the ends of the clasp base member such that the clasp member is pivotable into an extended position in which the clasp member extends beyond the end of the clasp base member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Various features of novelty which characterize the invention are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
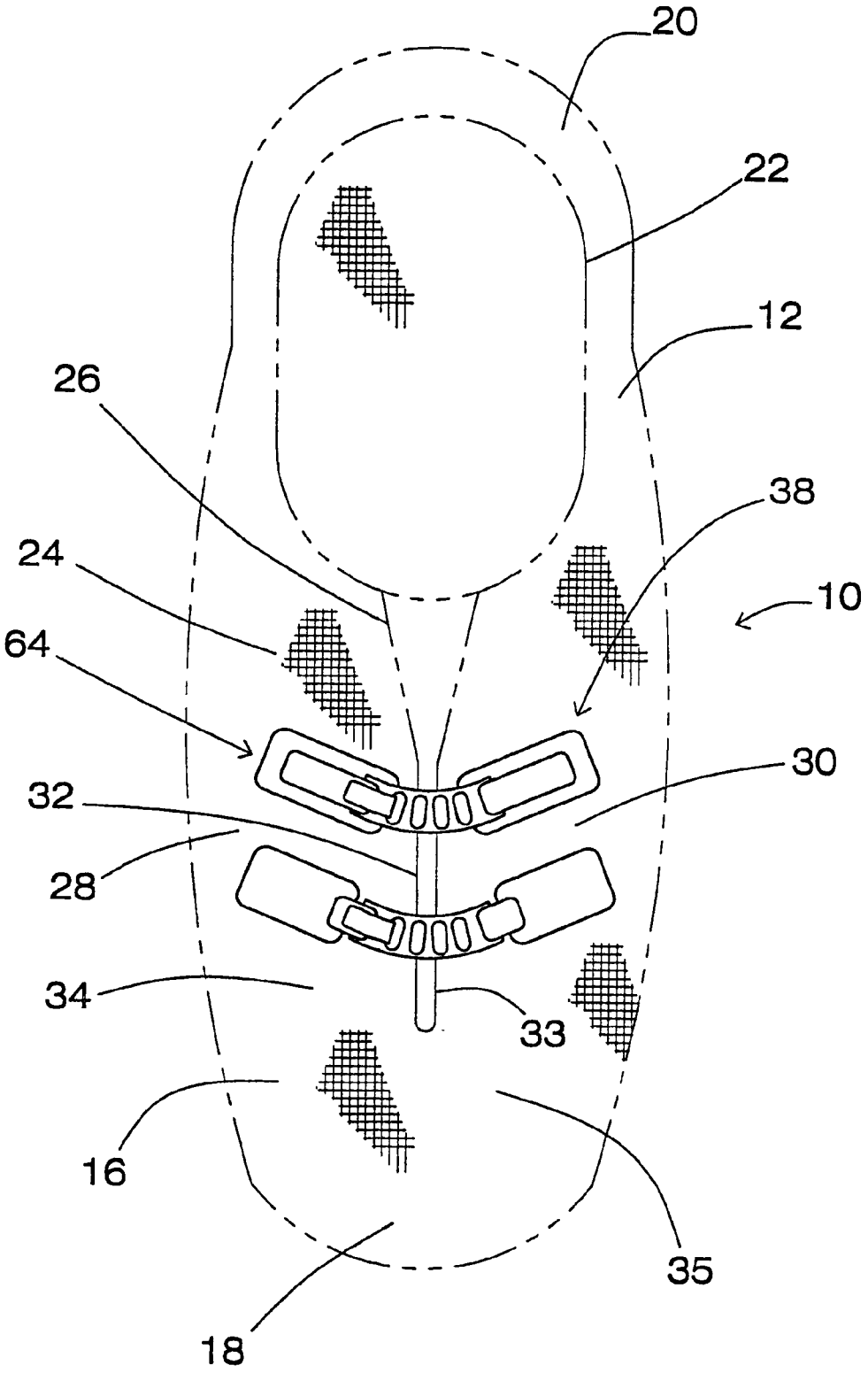
FIG. 1 is a schematic top view of an article of footwear with a new footwear closure fastener replacement system according to the present invention mounted thereon.
Figure 2:
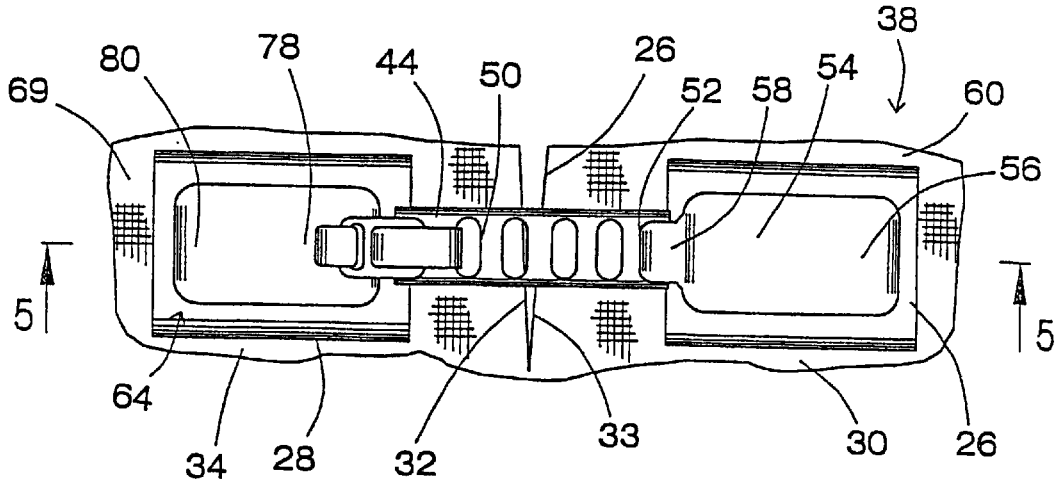
FIG. 2 is a schematic front perspective view of the ladder and clasp assemblies of the system of the present invention mounted on an article of footwear.
Figure 5:
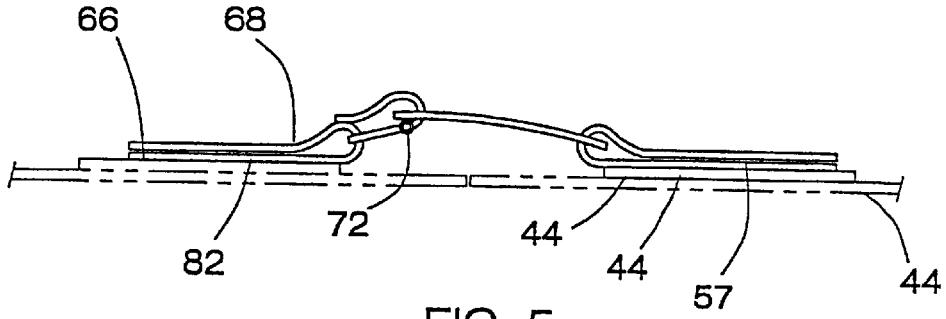
FIGS. 5 and 6 are schematic views of the ladder and clasp assemblies of the system of the present invention in the fastened and unfastened configurations, respectively.
Figure 6:
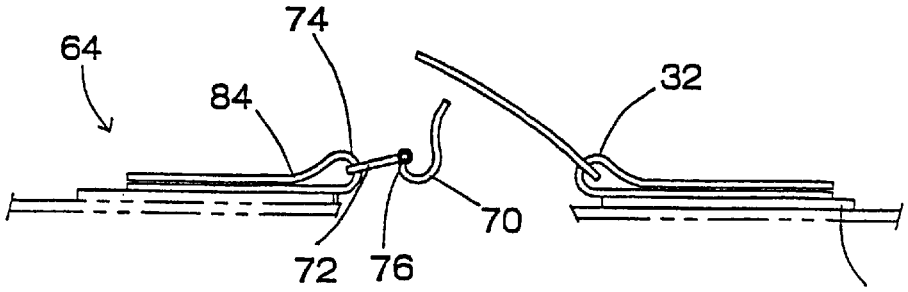
Figure 3:
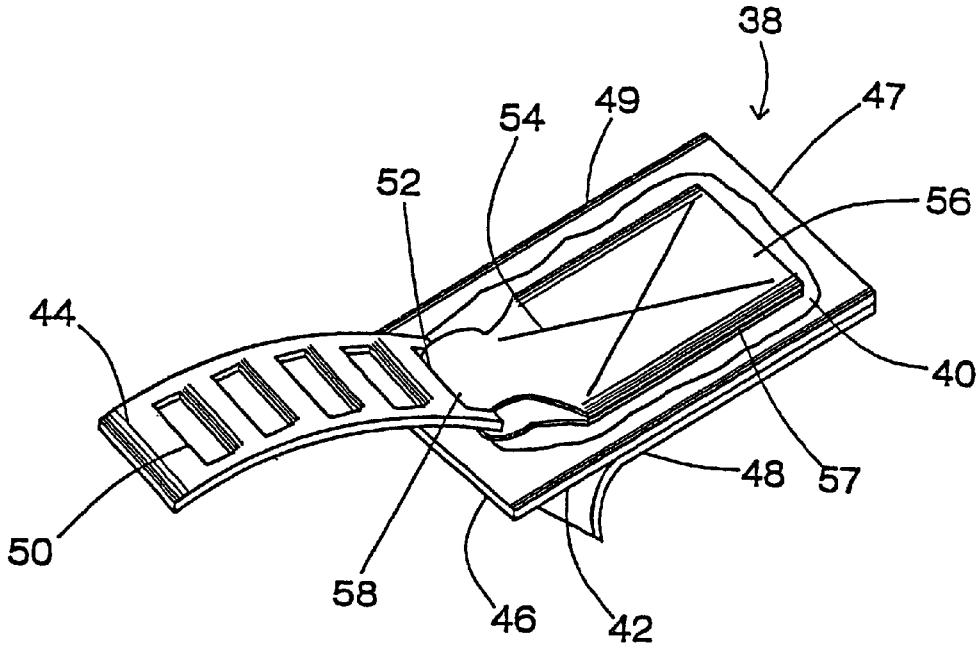
FIG. 3 is a schematic perspective view of the ladder assembly of the present invention.
Figure 4:
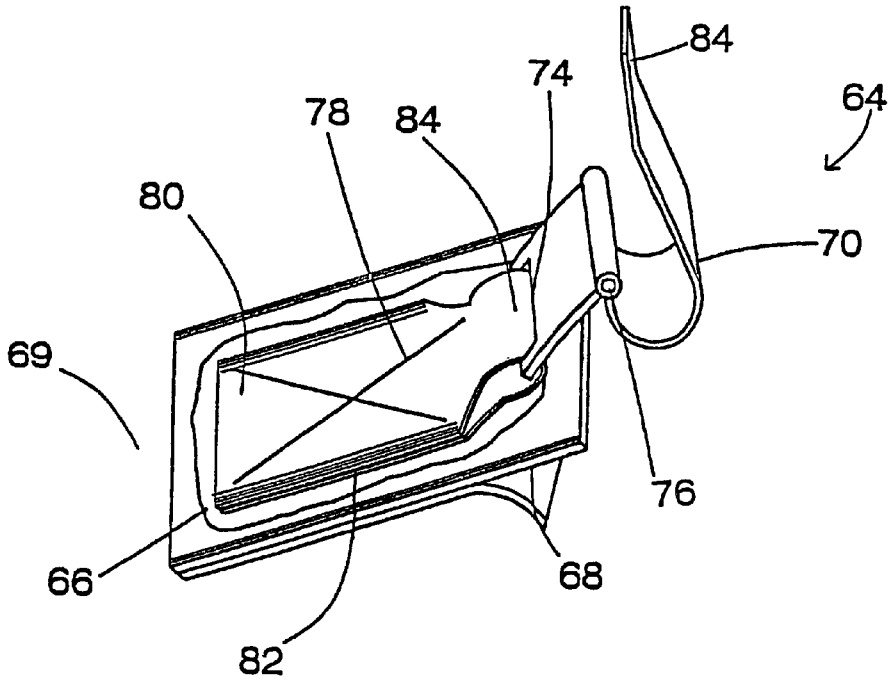
FIG. 4 is a schematic perspective view of the clasp assembly of the present invention.

With reference now to the drawings, and in particular to FIGS. 1 through 4 thereof, a new footwear closure fastener replacement system embodying the principles and concepts of the present invention and generally designated by the reference numeral 10 will be described.

As best illustrated in FIGS. 1 through 4, the footwear closure fastener replacement system 10 generally comprises a ladder assembly 38 or a clasp assembly 64 adapted for mounting on an article 12 of footwear in replacement of a broken closure fastener on the footwear.

The invention is most suitably employed on an article 12 of footwear, such as, for example, a boot, overshoe, galosh or the like that has a water impervious exterior. The article 12 of footwear typically has a sole (not shown) and an upper 16. The sole 14 and the upper 16 each have a toe 18 and a heel 20. The upper 16 has a leg opening 22 and a vamp 24. The vamp 24 extends forward from the leg opening 22 toward the toe 18. The vamp 24 has a slit 26 extending forwardly from the leg opening 22 toward the toe 18. The slit 26 divides the vamp 24 into side portions 28, 30 of the vamp. The side portions 28, 30 of the vamp each have a side edge 32, 33. The side edges 32, 33 define the slit 26. Each of the side portions 28, 30 have an outer surface 34, 35.

The invention includes a ladder assembly 38 adapted for mounting on the outer surface 34 of a first one of the side portions 28, preferably in a position adjacent to the side edge 32 of the side portion. Each ladder assembly includes a ladder base panel 40 for adhering to the outer surface 34 of the vamp 24 of the article 12 of footwear. The ladder base panel 40 has a lower surface 42 that is adapted for adhering to the outer surface of the footwear. Preferably, the lower surface of the ladder base panel is adapted for vulcanized bonding to the outer surface of the article of footwear which provides a durable bond between the base panel and the footwear. Optionally, other types of adhesive may be used to bond the base panel to the footwear.

The ladder assembly 38 also includes a ladder member 44. The ladder member 44 is mounted on the ladder base panel. The ladder member preferably has an arcuate shape. The ladder member is characterized by having a pair of end edges 46, 47 and a pair of side edges 48, 49. A plurality of clasp receiving apertures 50 are formed in the ladder member, and preferably the apertures are elongate with a longitudinal axis extending between the side edges 48, 49. The ladder member 44 has a mounting hole 52 located adjacent to one of the end edges 46, 47.

The ladder assembly also includes a ladder securing strip 54 for securing the ladder member 44 to the ladder base panel 40. The ladder securing strip 54 extends through the mounting hole 52 of the ladder member. Preferably, a first portion 56 of the ladder securing strip 54 is folded over onto a second portion 57 of the ladder securing member to form a loop 58 extending through the mounting hole 52 of the ladder member. The overlapped first 56 and second 57 portions of the ladder securing strip 54 are fastened to the ladder base panel. The overlapped portions of the ladder securing strip are preferably sewn to the ladder base panel with a thread Preferably, the ladder member is secured to the ladder base panel by the ladder securing strip in a manner such that the ladder member is pivotable with respect to the base panel, and preferably the ladder member is pivotable to an extended position in which the ladder member extends beyond one end of the ladder base panel such that when the ladder base panel is secured to the side portion of the vamp of the footwear, the ladder member may extend beyond the side edge of the slit and toward the other of the side portions of the vamp.

Optionally, a backing panel 60 is removably secured to the lower surface of the ladder base panel for protecting the vulcanization material or adhesive prior to application to the outer surface of the footwear. The backing panel is peelable from the base panel just prior to application of the base panel to the outer surface of the footwear.

The clasp assembly 64 of the invention is adapted for mounting a second one of the side portions of the vamp of the footwear adjacent to the side edge of the side portion.

The clasp assembly 64 includes a clasp base panel 66 for adhering to the outer surface of the vamp of the footwear. The clasp base panel 66 has a lower surface 68 that is adapted for adhering to the outer surface of the footwear. Preferably, the lower surface of the clasp base panel is adapted for vulcanized bonding to the outer surface of the article of footwear which provides a durable bond between the base panel and the footwear. A backing panel 69 is preferably provided for being removably secured to the lower surface of the clasp base panel for protecting the vulcanization materials or adhesive prior to application to the outer surface of the vamp of the footwear.

The clasp assembly 64 also includes a clasp member 70 for engaging the ladder member 44 of one of the ladder assemblies. The clasp member 70 is mounted on the clasp base panel 66. The clasp member 70 is adapted to extend through one of the clasp receiving apertures 50 of the ladder member 44. The clasp member may have an arcuate S-shape along its length.

The clasp assembly 64 also includes a clasp mounting member 72 that has the clasp member 70 pivotally mounted thereon. The clasp mounting member 72 has a mounting aperture 74. A hinge 76 pivotal connects the clasp member 70 to the clasp mounting member 72.

The clasp assembly further includes a clasp securing strip 78 provided for securing the clasp mounting member to the base panel. The clasp securing strip 78 extends through the mounting aperture 74 of the clasp mounting member 72. A first portion 80 of the clasp securing strip 78 is folded over onto a second portion 82 of the clasp securing member to form a loop 84 extending through the mounting aperture 74. The overlapped first 80 and second 82 portions of the clasp securing strip are fastened to the clasp base panel 66. The overlapped portions 80, 82 are preferably sewn to the clasp base panel by a thread or similar structure.

Similar to the ladder assembly, the clasp assembly is constructed so that the clasp member is pivotal with respect to the clasp base panel, and the clasp is positionable in an extended position in which the clasp member extends beyond one end of the clasp base panel such that when the clasp base panel is secured to the side portion of the vamp of the footwear, the clasp member may extend beyond the side edge of the slit and toward the other of the side portions of the vamp.

Illustratively, one embodiment of the assemblies has a base panel formed of a material utilized to patch holes in tire tubes, and formed out of a rubber or rubberized material. One illustrative embodiment of the base panel has a width measuring approximately 0.5 to approximately 1.5 inches, and has a length measuring approximately 1.5 inches to approximately 2.5 inches.

In use, a broken fastener is removed from the article of footwear, and, depending upon the fastener being replaced, the remainder of the broken fastener is essentially completely removed from the vamp of the footwear, and the outer surface of the vamp is prepared. In the case of the preferred embodiment, the outer surface may be scuffed and an application of a bonding agent for vulcanization is applied and allowed to dry. The backing panel is removed from the lower surface of the base panel, and the lower surface is pressed against the outer surface of the vamp. Preferably, the base panel is positioned on the side portion of the vamp with an end of the base panel is located adjacent to the side edge of the side portion so that the clasp member or clamp member extends beyond the side edge for engaging a complementary fastener such as a clasp or ladder assembly. It will be realized that only broken fasteners need to be replaced, and that the fasteners of the invention do not need to be used in pairs and may be used with and connected to original fasteners on the article of footwear.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for repairing a fastener of an article of footwear having a vamp with a slit dividing the vamp into side portions, the side portions each having a side edge and an outer surface, the system comprising:

a first fastener assembly for mounting on a first one of the side portions adjacent to the side edge of the first side portion, the first fastener assembly including:

a first base panel having a lower surface for adhering to the outer surface of the first side portion of the footwear; and a first fastener member mounted on an upper surface of the first base panel; and a second fastener assembly for mounting on a second one of the side portions adjacent to the side edge of the second side portion, the second fastener assembly including:

a second base panel having a lower surface for adhering to the outer surface of the second side portion of the footwear;

a second fastener member mounted on an upper surface of the second base panel;

wherein the second fastener member is complementary to the first fastener member such that the first and second fastener members may be engaged and disengaged for permitting selective joining of the side portions of the footwear; and wherein the lower surfaces of the first and second fastener assemblies are provided with a bonding agent preapplied thereto;

wherein the bonding agent is adapted for forming vulcanized bond to the outer surface of the article of footwear.

2. The system of claim 1 wherein the first fastener comprises a ladder fastener and the second fastener comprises a clasp fastener.

3. A system for repairing a fastener of an article of footwear having a vamp with a slit dividing the vamp into side portions, the side portions each having a side edge and an outer surface, the system comprising:

a ladder assembly for mounting on one of the side portions adjacent the side edge of the side portion, the ladder assembly including:

a ladder base panel having a lower surface for adhering to the outer surface of the side portion of the footwear;

a ladder member being pivotally mounted on the ladder base panel, a plurality of clasp receiving apertures being formed on the ladder member, the ladder member having a mounting hole adjacent one end of the ladder member; and a ladder securing strip securing the ladder member to the ladder base panel, the ladder securing strip extending through the mounting hole of the ladder member;

wherein the lower surface of the ladder base panel is adapted for vulcanized bonding to the outer surface of the article of footwear.

4. The system of claim 3 wherein the ladder member is mounted adjacent to an end of the ladder base member such that the ladder member is pivotable into an extended position in which the ladder member extends beyond the end of the ladder base member.

5. The system of claim 3 wherein a first portion of the ladder securing strip is folded over onto a second portion of the ladder securing member to form a loop extending through the mounting hole of the ladder member, the overlapped first and second portions of the ladder securing strip being fastened to the ladder base panel.

6. The system of claim 5 wherein the overlapped portions of the ladder securing strip are sewn to the ladder base panel.

7. The system of claim 3 additionally comprising a backing panel being removably secured to the lower surface of the ladder base panel.

8. The system of claim 3 wherein the ladder member has a pair of end edges and a pair of side edges, the clasp receiving apertures being elongate and having a longitudinal axis extending between the side edges.

9. A system for repairing a fastener of an article of footwear having a vamp with a slit dividing the vamp into side portions, the side portions each having a side edge and an outer surface, the system comprising:

a clasp assembly for mounting on one of the side portions adjacent the side edge thereof, the clasp assembly including:

a clasp base panel having a lower surface for adhering to the outer surface of the side portion of the footwear;

a clasp member for engaging a ladder member of a ladder assembly, the clasp member being pivotally mounted on the clasp base panel, the clasp member being adapted to extend through a clasp receiving aperture of the ladder member; and a clasp securing strip pivotally mounting the clasp member to the base panel;

wherein the lower surface of the clasp base panel is adapted for vulcanized bonding to the outer surface of the article of footwear.

10. The system of claim 9 wherein the clasp member is mounted adjacent to an end of the clasp base member such that the clasp member is pivotable into an extended position in which the clasp member extends beyond the end of the clasp base member.

11. The system of claim 9 additionally comprising a backing panel being removably secured to the lower surface of the clasp base panel.

12. The system of claim 9 wherein the clasp member has an arcuate S-shape.

13. The system of claim 9 additionally comprising a clasp mounting member with the clasp member being pivotally mounted on the clasp mounting member, the clasp mounting member having a mounting aperture.

14. The system of claim 13 additionally comprising a hinge pivotally connecting the clasp member to the clasp mounting member.

15. The system of claim 14 wherein the clasp securing strip extends through the mounting aperture of the clasp mounting member, a first portion of the clasp securing strip being folded over onto a second portion of the clasp securing member to form a loop extending through the mounting aperture, the overlapped first and second portions of the clasp securing strip being fastened to the clasp base panel.

16. The system of claim 15 wherein the overlapped portions of the clasp securing strip are sewn to the clasp base panel.

17. A system for repairing a fastener of an article of footwear having a vamp with a slit dividing the vamp into side portions, the side portions each having a side edge and an outer surface, the system comprising:

a ladder assembly for mounting on one of the side portions adjacent the side edge of the side portion, the ladder assembly including:

a ladder base panel having a lower surface for adhering to the outer surface of the side portion of the footwear;

a ladder member being pivotally mounted on the ladder base panel, a plurality of clasp receiving apertures being formed on the ladder member, the ladder member having a mounting hole adjacent one end of the ladder member; and a ladder securing strip securing the ladder member to the ladder base panel, the ladder securing strip extending through the mounting hole of the ladder member;

wherein the ladder member is mounted adjacent one of the ends of the ladder base member such that the ladder member is pivotable into an extended position in which the ladder member extends beyond the end of the ladder base member; and wherein the lower surface of the ladder base panel is adapted for vulcanized bonding to the outer surface of the article of footwear;

a clasp assembly for mounting on a second one of the side portions adjacent the side edge of the side portion, the clasp assembly including:

a clasp base panel having a lower surface for adhering to the outer surface of the side portion of the footwear;

a clasp member for engaging the ladder member of the ladder assembly, the clasp member being pivotally mounted on the clasp base panel, the clasp member being adapted to extend through one of the clasp receiving apertures of the ladder member; and a clasp securing strip pivotally mounting the clasp member to the base panel;

wherein the clasp member is mounted adjacent one of the ends of the clasp base member such that the clasp member is pivotable into an extended position in which the clasp member extends beyond the end of the clasp base member; and wherein the lower surface of the ladder base panel is adapted for vulcanized bonding to the outer surface of the article of footwear.

18. The system of claim 1 additionally comprising a backing panel adhered to the lower surface of each of the base panels, the backing panel being removable from adhesion to each of the base panels to expose the bonding agent.

* * * * *